US009517392B2

(12) United States Patent
Ueda

(10) Patent No.: US 9,517,392 B2
(45) Date of Patent: Dec. 13, 2016

(54) IRON-TYPE GOLF CLUB HEAD

(71) Applicant: Dunlop Sports Co. Ltd., Kobe-shi, Hyogo (JP)

(72) Inventor: Naoyoshi Ueda, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 214 days.

(21) Appl. No.: 14/311,599

(22) Filed: Jun. 23, 2014

(65) Prior Publication Data

US 2015/0038263 A1 Feb. 5, 2015

(30) Foreign Application Priority Data

Jul. 30, 2013 (JP) ..... 2013-158108

(51) Int. Cl.
*A63B 53/04* (2015.01)

(52) U.S. Cl.
CPC ..... *A63B 53/047* (2013.01); *A63B 53/04* (2013.01); *A63B 2053/0408* (2013.01); *A63B 2053/0433* (2013.01); *A63B 2053/0445* (2013.01); *A63B 2053/0491* (2013.01); *A63B 2209/00* (2013.01)

(58) Field of Classification Search
CPC ..... A63B 2053/0433; A63B 2053/0491; A63B 53/047
USPC ..... 473/312, 335, 341, 344, 348, 349
See application file for complete search history.

(56) References Cited

U.S. PATENT DOCUMENTS 5,833,551 A * 11/1998 Vincent ..... A63B 53/04 473/349
2004/0180732 A1* 9/2004 Reyes ..... A63B 53/0466 473/349
2006/0084527 A1* 4/2006 Nycum ..... A63B 53/047 473/350
2007/0117651 A1* 5/2007 Belmont ..... A63B 53/0466 473/349
2007/0281796 A1 12/2007 Gilbert et al.
2009/0305815 A1* 12/2009 Hirano ..... A63B 53/047 473/350
2011/0256953 A1* 10/2011 Jorgensen ..... A63B 53/047 473/324
2012/0231897 A1* 9/2012 Hettinger ..... A63B 53/02 473/349
2013/0344988 A1* 12/2013 Hettinger ..... A63B 53/047 473/349

FOREIGN PATENT DOCUMENTS

JP 2007-319687 A 12/2007

* cited by examiner

*Primary Examiner* — Benjamin Layno
(74) *Attorney, Agent, or Firm* — Birch, Stewart, Kolasch & Birch, LLP

(57) ABSTRACT

An iron-type golf club head has a face for hitting a ball, a sole extending backward from the lower edge of the face and extending in the toe-heel direction of the head so as to define the bottom surface of the club head, and a hosel extending upward in a heel-side of the face and provided with a shaft inserting hole. The club head is composed of a head main body including the face, and a weight member having a specific gravity larger than that of the head main body and fixed to the head main body. The weight member integrally includes a first part extending in the toe-heel direction in the sole, and a second part constituting at least substantial portion of the hosel.

12 Claims, 7 Drawing Sheets

IRON-TYPE GOLF CLUB HEAD

BACKGROUND OF THE INVENTION

The present invention relates to an iron-type golf club head including a weight member having an improved configuration capable of easily hitting a golf ball high and excellent in the directional stability of hit balls.

Hitherto, various sorts of iron-type golf club heads have been proposed in order to improve the directional stability of hit balls and the flying distance.

For example, the following patent document 1 discloses an iron-type golf club head in which weight members having relatively high specific gravity are respectively embed in the toe portion, heel portion and sole portion of the club head.

Such club head can be provided with the lowered center of gravity and an increased moment of inertia around a vertical axis passing through the center of gravity of the head, therefore, the club head is excellent in the directional stability of hit balls, and it is easy to hit a golf ball high.

In the golf club head according to the patent document 1, however, there is room for improvement in the moment of inertia and lowering of the center of gravity.

[patent document 1] Japanese Patent Application Publication No. 2007-319687

SUMMARY OF THE INVENTION

It is therefore, an object of the present invention to provide an iron-type golf club head which is excellent in the directional stability of hit balls and capable of easily hitting a golf ball high.

According to the present invention, an iron-type golf club head having a face for hitting a ball, a sole extending backward from the lower edge of the face and extending in the toe-heel direction of the head so as to define the bottom surface of the club head, and a hosel extending upward in a heel-side of the face and provided with a shaft inserting hole, comprises a head main body including the face and a weight member having a specific gravity larger than that of the head main body and fixed to the head main body, wherein the weight member integrally includes a first part extending in the toe-heel direction in the sole, and a second part constituting at least substantial portion of the hosel.

The iron-type golf club head according to the present invention may include the following features (1)-(7):

(1) the toe-side end of the first part is positioned on the toe-side of the sweet spot of the face:

(2) the toe-side end of the first part is positioned at a distance not more than 20 mm from the toe-side end of the face;

(3) the first part has an upper surface whose height from the horizontal plane is increased toward the toe-side of the club head in a standard state of the club head set on a horizontal plane at its specified lie angle and loft angle;

(4) in the bottom view of the club head in a standard state of the club head set on a horizontal plane at its specified lie angle and loft angle, the width of the first part measured in the front-back direction of the club head is increased toward the toe-side of the club head;

(5) the head main body includes the sole, wherein the sole is provided with a groove extending in the toe-heel direction, and the first part is inserted into the groove;

(6) the head main body has a heel-side end surface extending in the up-and-down direction, and the second part has a contact surface extending in the up-and-down direction, wherein the contact surface is confronted with the heel-side end surface by the insertion of the first part of the weight member into the groove;

(7) the head main body is a composite body of a stainless steel and a titanium alloy, and the weight member is made of a tungsten alloy.

Thus, the iron-type golf club head according to the present invention comprises a head main body including the face and a weight member having a specific gravity larger than that of the head main body and fixed to the head main body, and the weight member integrally includes a first part extending in the toe-heel direction in the sole, and a second part constituting at least substantial portion of the hosel.

Such first part can distribute more mass to the sole of the club head continuously along the toe-heel direction to lower the position of the center of gravity of the head.

Since the second part of the weight member constitutes the hosel located in a heel-side of the club head, the second part can distribute more mass to the heel-side.

In the club head according to the present invention, therefore, the lowering of the center of gravity of the head and the increasing of the moment of inertia can be achieved by the single weight member.

As a result, the club head according to the present invention is excellent in the directional stability of hit balls and it is easy to hit a golf ball high.

In this application including the description and claims, dimensions, positions, directions and the like relating to the club head refer to those under a standard state of the club head unless otherwise noted.

Here, the standard state of the club head is such that the club head is set on a horizontal plane HP so that the axis of the club shaft (not shown) is inclined at the specified lie angle alpha while keeping the axis on a vertical plane, and the face forms the specified loft angle with respect to the horizontal plane HP.

Incidentally, in the case of the club head alone, the center line CL of the shaft inserting hole can be used instead of the axis of the club shaft.

"Front-back direction" is a direction parallel with a straight line projected on the horizontal plane HP, wherein the straight line is drawn normally to the face passing through the center G of gravity of the club head.

"Toe-heel direction" is a direction parallel with the horizontal plane HP and perpendicular to the front-back direction.

DESCRIPTION OF THE PREFERRED EMBODIMENTS

Embodiments of present invention will now be described in detail in conjunction with accompanying drawings.

The present invention may be applied to an iron-type golf club head regardless of the lie angle alpha and the loft angle beta.

Typically and in the following embodiment, the lie angle alpha is set in a range of from 50 to 70 degrees, and the loft angle beta is set in a range of from 15 to 70 degrees.

Figure 1:
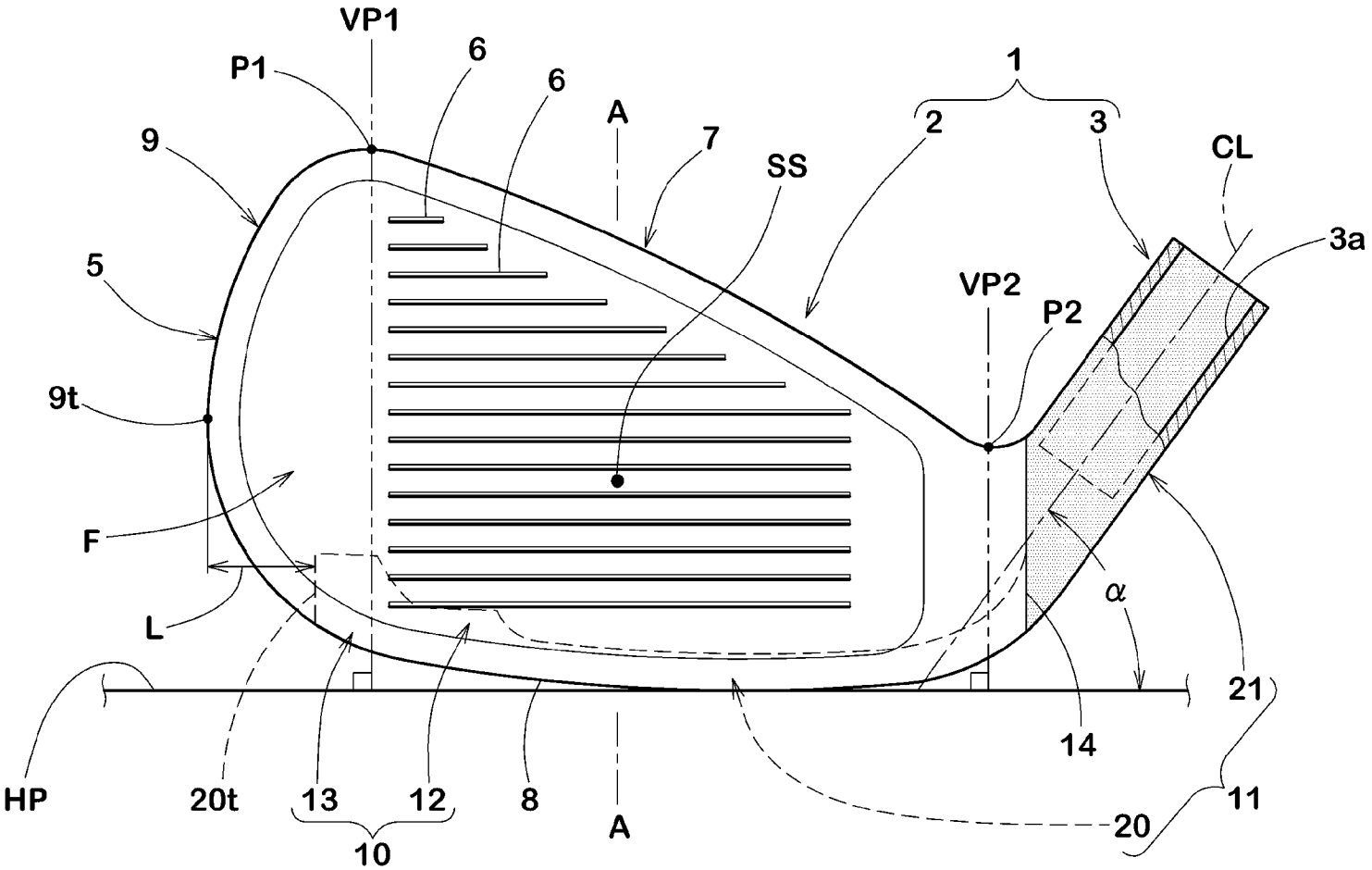
FIG. 1 is a front view of an iron-type golf club head as an embodiment of the present invention in its standard state.
Figure 2:
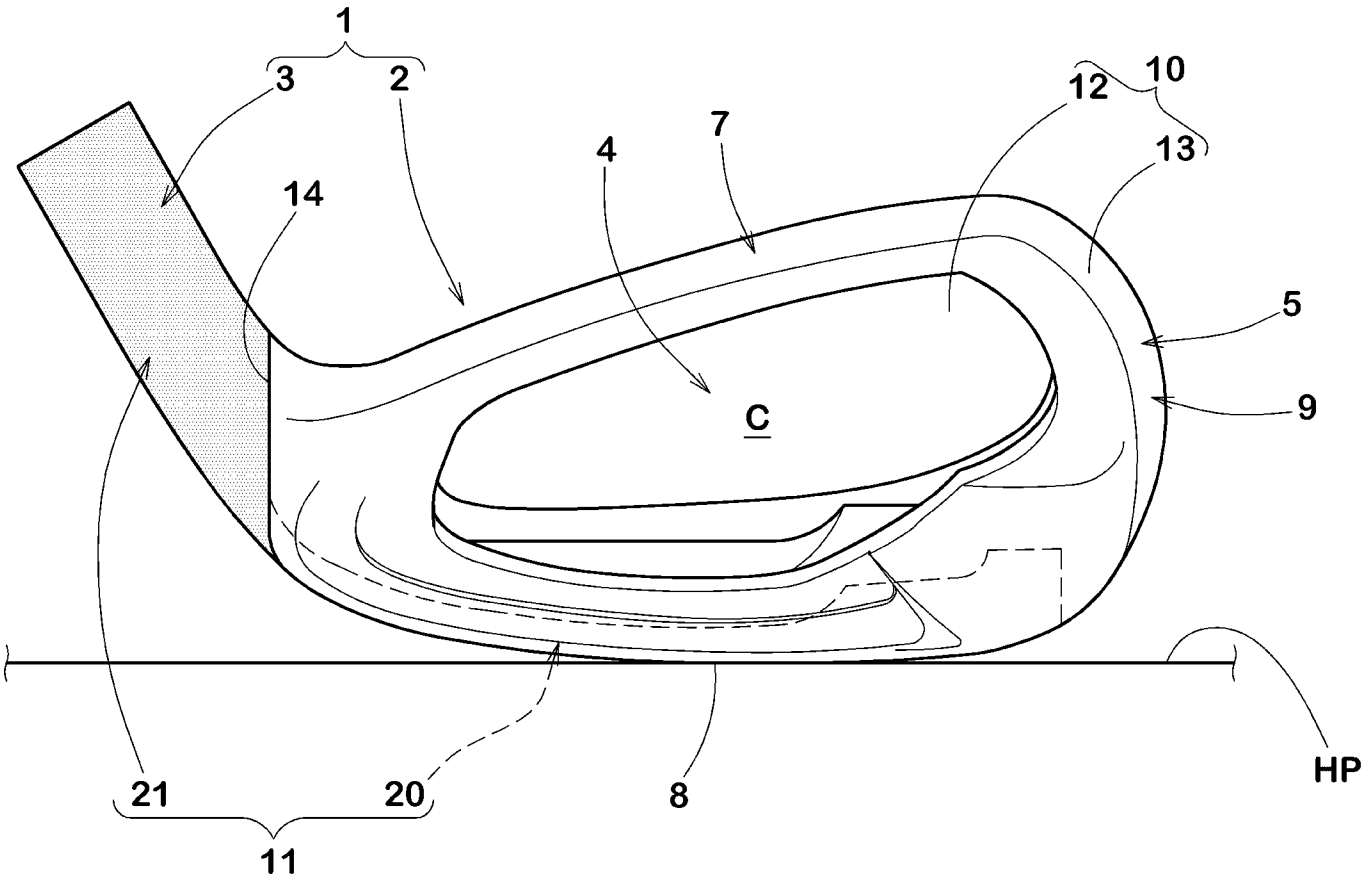
FIG. 2 is a rear view of the iron-type golf club shown in FIG. 1.

In FIGS. 1 and 2 showing a club head 1 as an embodiment of the present invention, the club head 1 includes a club head main body 2 and a hosel 3.

The club head main body 2 is defined by a face F, a back face 4, and a circumferential surface 5.

The face F is a surface for hitting a ball. The face F is a single part formed by a surface which is substantially flat excepting impact area markings 6 if any. As for an impact area marking 6, typical, a groove is used, but a punch mark or the like may be used too.

The back face 4 is a surface on the opposite side of the face F as shown in FIG. 2.

In this embodiment, a cavity C is formed in the back face 4.

The circumferential surface 5 extends between the face F and the back face 4 as shown in FIG. 1. The circumferential surface 5 includes a top 7, the sole 8 and a toe surface 9.

The top 7 is a surface extending backwardly of the club head from the upper edge of the face F to form the upper surface of the club head.

The sole 8 is a surface extending backwardly of the club head from the lower edge of the face F so as to form the bottom surface of the club head.

The toe surface 9 extends between the top 7 and the sole 8. The toe surface 9 includes a toe-side end 9*t* which is a toe-side extreme end of the head in the toe-heel direction.

The upper edge of the face F has a toe-side high point P1 which is the uppermost point and a heel-side low point P2 which is the lowermost point.

The top 7 is a part of the circumferential surface 5 extending, on the upper side of the club head, between a vertical plane VP1 on the toe-side and a vertical plane VP2 on the heel-side.

Here, the vertical plane VP1 is defined as including the toe-side high point P1 and being perpendicular to the face F. The vertical plane VP2 is defined as including the heel-side low point P2 and being perpendicular to the face F.

The sole 8 is a part of the circumferential surface 5 extending, on the under side of the club head, between the vertical plane VP1 on the toe-side and the vertical plane VP2 on the heel-side.

The hosel 3 is a tubular portion and formed in a heel-side of the club head main body 2. The hosel 3 is provided with a bottomed shaft inserting hole 3*a* into which a shaft (not shown) is inserted.

The club head 1 includes, as its constructional members, a head main body 10 and a weight member 11 having a specific gravity more than that of the head main body 10.

Figure 5:
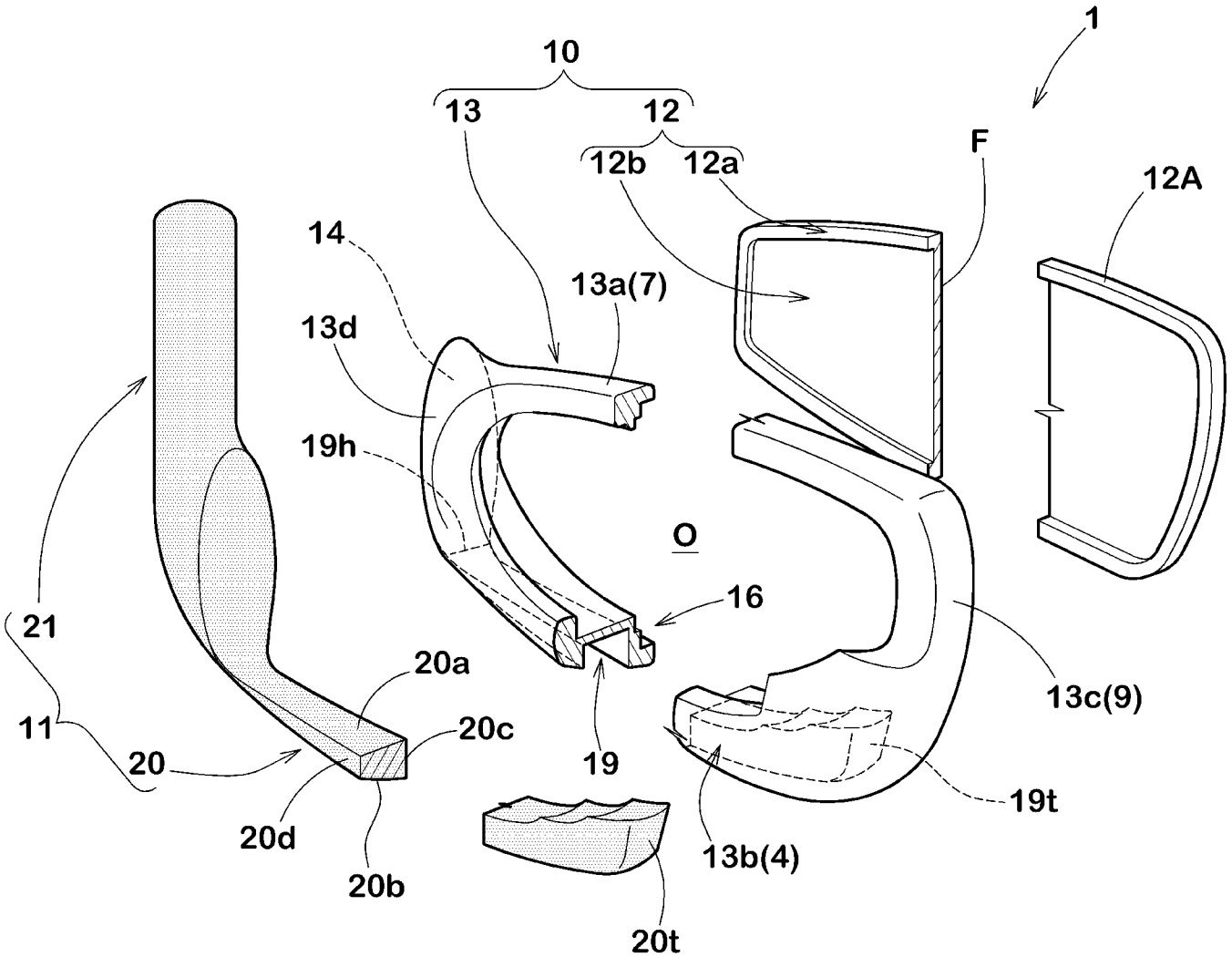
FIG. 5 is an exploded perspective view of the iron-type golf club head shown in FIG. 1.

FIG. 5 is an exploded perspective view of the club head 1 according to this embodiment.

Figure 4:
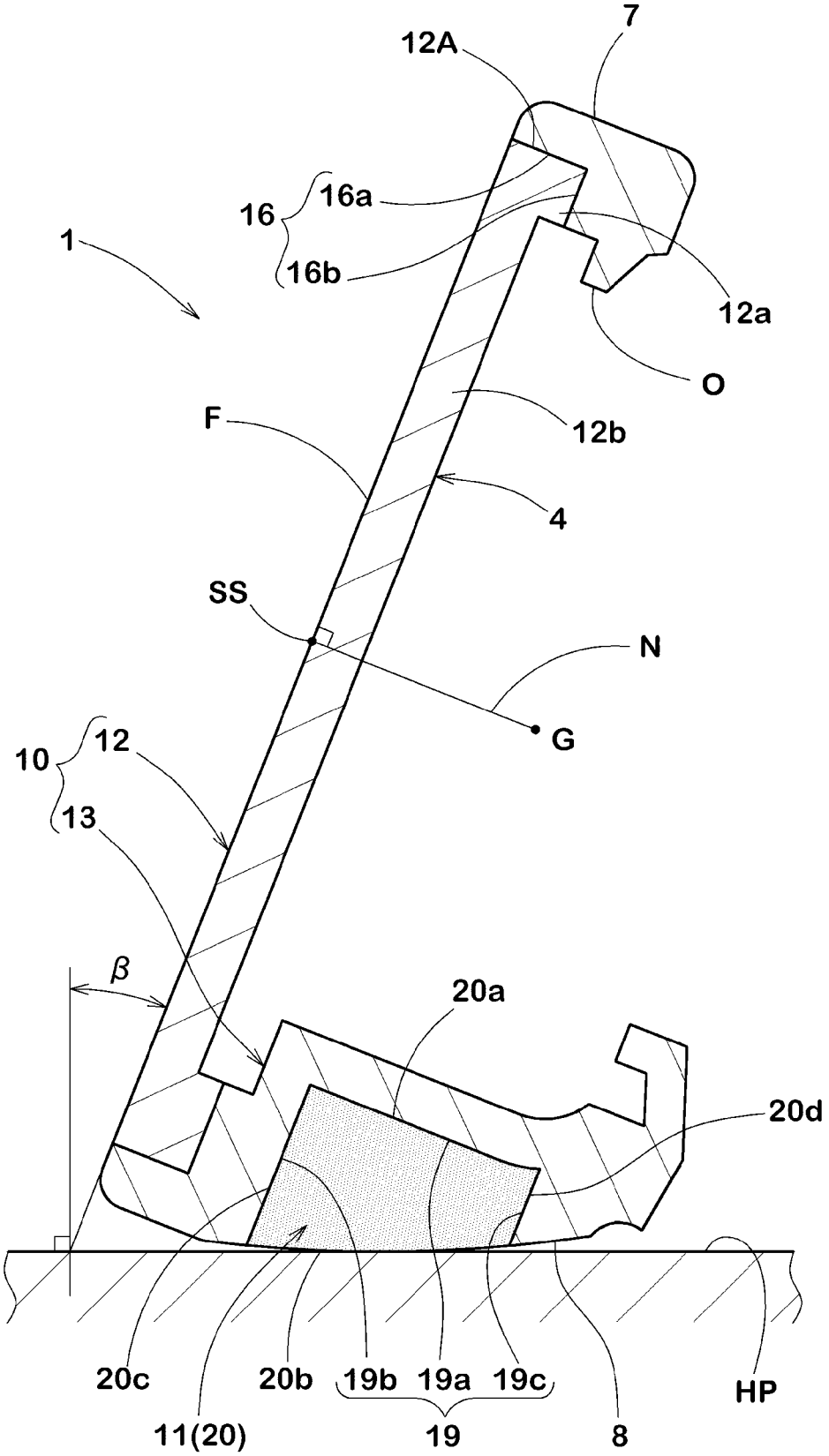
FIG. 4 is a cross section of the iron-type golf club taken along line A-A in FIG. 1.

As shown in FIG. 4 and FIG. 5, the head main body 10 in this embodiment is formed by joining a face member 12 with a face-receiving part 13.

The head main body 10 is however, not limited to such construction. The head main body 10 may be formed as an integral molding.

The face member 12 is a plate having a surrounding circumferential surface 12A. The face member 12 forms at least part of, preferably a major part of the face F.

The face member 12 in this embodiment comprises a periphery zone 12*a* which is relatively thick and a central zone 12*b* which is relatively thin when compared with the periphery zone 12*a* and surrounded by the periphery zone 12*a*. It is however, also possible to configure the face member 12 to have a substantially constant thickness.

The above-mentioned face-receiving part 13 in this embodiment extends circularly as shown in FIG. 5 so as to define an opening O penetrate through the head main body 10 in the front-back direction.

The face-receiving part 13 comprises a top frame 13*a*, a sole frame 13*b*, a toe frame 13*c* and a heel frame 13*d*.

The top frame 13*a* defines the top 7.

The sole frame 13*b* defines a part of the sole 8.

Preferably, the width of the face-receiving part 13 measured in the front-back direction of the club head is larger in the sole frame 13*b* than in the top frame 13*a*, toe frame 13*c* and heel frame 13*d* in order to distribute more mass to a lower position of the club head.

The width of the sole frame 13*b* is gradually increased toward the toe-side of the club head.

The sole frame 13*b* is provided with a groove disposed in the sole 8 and extending in the toe-heel direction 19.

The toe frame 13*c* extends, on the toe-side, between the top frame 13*a* and the sole frame 13*b* to define the toe surface 9.

The heel frame 13*d* extends, on the heel-side, between the top frame 13*a* and the sole frame 13*b*.

The heel frame 13*d* has a heel-side end surface 14 which is a flat surface extending in the up-and-down direction.

The face-receiving part 13 is, as shown in FIG. 4, provided in the front thereof with a face mounting portion 16 to which the face member 12 is attached.

The face mounting portion 16 is a stepped hole having an inner circumferential surface 16*a* facing toward the center of the club head, and a step surface 16*b* facing toward the face side.

The face member 12 is fitted in the face mounting portion 16 so that the outer circumferential surface 12A of the face member 12 abuts on the inner circumferential surface 16*a*, and the back surface of the face member 12 abuts on the step surface 16*b*.

The face member 12 and the face mounting portion 16 are fixed to each other by fixing means for example adhesive bonding, press fitting, caulking, welding, screw fastening and/or the like.

By attaching the face member 12 to the face mounting portion 16, the opening O is closed thereby, and an open cavity C is formed on the back side of the face member 12.

In the face member 12 in this embodiment, only the periphery zone 12*a* is supported by the face-receiving part 13.

The periphery zone 12*a* having a larger thickness improves the durability of the joining portion with the face-receiving part 13. The periphery zone 12*a* distributes more weight to the periphery of the face F and provides a wide high-restitution-coefficient area.

On the other hand, the central zone 12*b* does not touch the face-receiving part 13.

Therefore, at the time of hitting a ball, the central zone 12*b* of the face member 12 can freely deflect toward the backside of the club head to improve the rebound performance.

Preferably, the face member 12 is made of a material having a specific gravity less than that of the face-receiving part 13 in order to distribute more mass to the periphery of the face F, and increase the sweet spot area.

For example, a titanium alloy is suitably used as the material of the face member 12.

For the face-receiving part 13, on the other hand, stainless steel, maraging steel, Ni-based alloy or soft iron can be suitably used.

As described above, the head main body 10 is preferably formed from two or more kinds of materials having different specific gravities. In this case, the specific gravity of the head main body 10 is given by the average of the specific gravities of the materials weighted by the respective volumes of the materials. For example, in this embodiment where the head main body 10 is a composite body of the face member 12 made of the titanium alloy and the face-receiving part 13 made of a stainless steel, the average of the specific gravities of these two materials becomes about 5.8.

The weight member 11 is made of a material having a specific gravity more than that of the head main body 10.

For the weight member 11, one kind or more kinds of metal materials selected from tungsten, tungsten alloys, copper alloys, nickel alloys and the like can be suitably used.

In this embodiment, the weight member 11 is made of a tungsten nickel alloy having a specific gravity of about 9.5.

Figure 3:
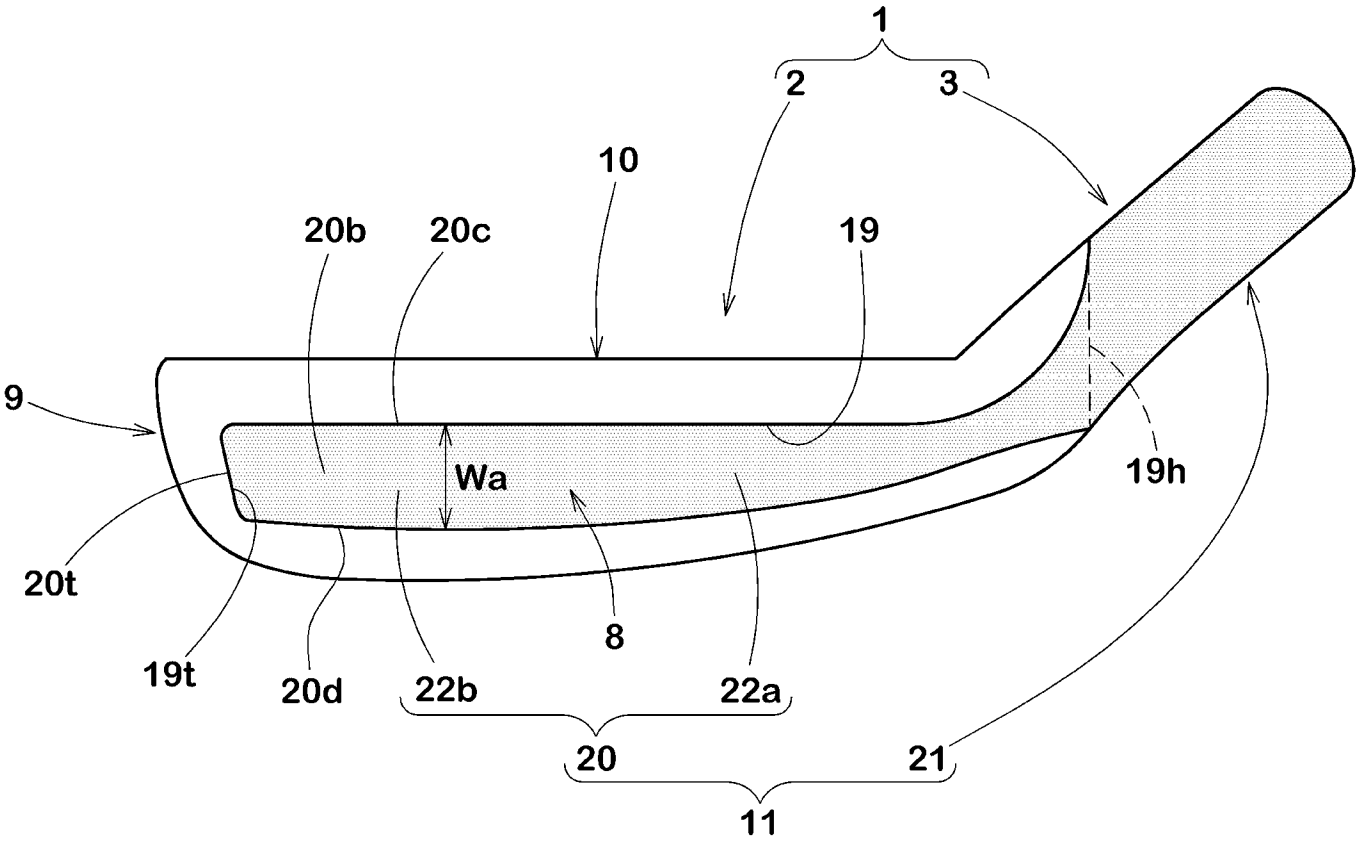
FIG. 3 is a bottom view of the iron-type golf club shown in FIG. 1.

As shown in FIGS. 1-3, the weight member 11 integrally includes a first part 20 and a second part 21.

In the sole 8, as shown in FIG. 3, the first part 20 extends in the toe-heel direction.

Therefore, the first part 20 distributes more mass to the base portion of the club head 1 continuously along the toe-heel direction, and the first part 20 can lower the position of the center G of gravity of the head.

The second part 21 constitutes the hosel 3.

Therefore, the second part 20 distributes more mass to a heel-side of the head.

Accordingly, the weight member 11 provides a large moment of inertia around the vertical axis passing through the center G of gravity of the head (hereinafter, the right-and-left moment of inertia).

Thus, the club head 1 according to the present invention is provided with the lowered center of gravity of the head and the increased right-and-left moment of inertia.

Thereby, it is possible to easily hit a golf ball high and the club head 1 is excellent at the directional stability of hit balls.

As explained, the first part 20 and the second part 21 of the weight member 11 are integrally formed. Such weight member 11 can prevent the head main body 10 from being twisted when hitting a ball.

If the first part 20 and the second part 21 are separated from each other and attached to the head main body 10, a part of the head main body 10 between the first part 20 and the second part 21 is subjected to a large bending stress and moment when hitting a ball, and there is a possibility that the durability of the head main body 10 is decreased.

In the present invention, as the first part 20 and the second part 21 are integrally formed, these parts function as a reinforcing member and can improve the durability of the head main body 10.

In this embodiment, the first part 20 of the weight member 11 is fixed into a groove 19 provided in the sole frame 13*b*.

As a result, the first part 20 is exposed in the bottom surface of the club head to form a part of the sole 8.

As shown in FIG. 4, the groove 19 has a bottom surface 19*a*, a front sidewall surface 19*b* on the face side, and a rear sidewall surface 19*c* on the back surface side.

The bottom surface 19*a* includes a part which is deepest from the sole 8 and extends perpendicularly to the face F.

The front sidewall surface 19*b* and the rear sidewall surface 19*c* extend from the bottom surface 19*a* to the sole 8.

Each of the front sidewall surface 19*b* and the rear sidewall surface 19*c* includes a part extending substantially parallel with the face F.

Therefore, the cross sectional shape of the groove 19 taken along a plane perpendicular to the face F is substantially rectangular or trapezoidal.

As shown in FIG. 4, the first part 20 of the weight member 11 has an upper surface 20*a*, a lower surface 20*b*, a front surface 20*c* and a rear surface 20*d*.

The upper surface 20*a* is a surface facing upward in the standard state of the club head 1. The upper surface 20*a* abuts on the bottom surface 19*a* of the groove 19.

The lower surface 20*b* is a surface facing downward in the standard state of the club head 1. The lower surface 20*b* in this embodiment is exposed in the sole 8 as a part thereof and smoothly continues to the outer surface of the face-receiving part 13.

The front surface 20*c* is a surface connecting between the upper surface 20*a* and the lower surface 20*b* on the face side. The front surface 20*c* abuts on the front sidewall surface 19*b* of the groove 19.

The rear surface 20*d* is a surface connecting between the upper surface 20*a* and the lower surface 20*b* on the rear side. The rear surface 20*d* abuts on the rear sidewall surface 19*c* of the groove 19.

The cross sectional shape of the first part 20 is substantially same as that of the groove 19.

By inserting the first part 20 into the groove 19 from the under side of the club head, the first part 20 is uniquely positioned with respect to the front-back direction of the club head.

The cross sectional shape of the groove 19 is not limited to the above example. For example, a cross sectional shape tapered toward the bottom surface 19*a* such as trapezoid, semicircle and triangle may be used.

As shown in FIG. 3 and FIG. 5, the groove 19 has a toe-side end 19*t* and a heel-side end 19*h*.

The toe-side end 19*t* is positioned within the face-receiving part 13.

The heel-side end 19*h* is opened at the heel-side end surface 14 of the face-receiving part 13.

The length of the groove 19 measured in the toe-heel direction is substantially same as the length of the first part 20 of the weight member 11 measured in the toe-heel direction. The toe-side end 20*t* of the first part 20 is butted with the toe-side end 19*t* of the groove 19, and its movement toward the toe-side is inhibited.

Preferably, the toe-side end 20*t* of the first part 20 is positioned on the toe-side of the sweet spot SS of the club head 1 as shown in FIG. 1.

Here, the sweet spot SS is, as shown in FIG. 4, an intersecting point between the face F and a normal line N thereto drawn from the center G of gravity of the head.

As shown in FIG. 1, the first part 20 of the weight member 11 is longer in the toe-heel direction than in the front-back direction.

Therefore, the club head 1 can be distributed with large mass to the toe-side and the heel-side so as to further increase the right-and-left moment of inertia.

Preferably, the toe-side end 20*t* of the first part 20 is positioned at a distance L of less than 20 mm from the toe-side end 9*t* of the face F in order to effectively derive this function.

Figure 6:
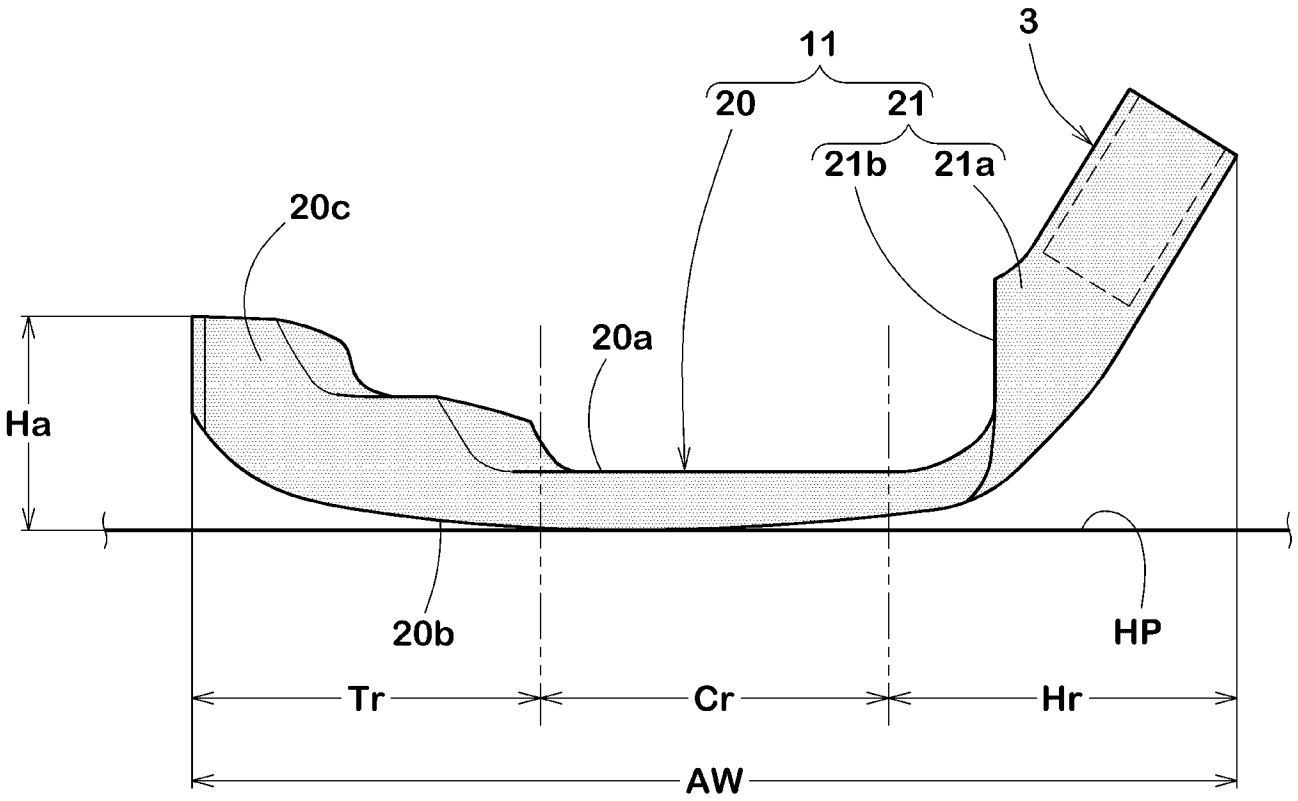
FIG. 6 is a front view of the weight member in this embodiment.

As shown in FIG. 6 which is a front view of the weight member 11 in its standard state corresponding to the standard state of the club head 1, the height Ha from the horizontal plane HP, of the upper surface 20*a* of the first part 20 is preferably increased toward the toe-side of the club head. Such first part 20 makes it possible to distribute more mass to the toe-side to provide a further increased right-and-left moment of inertia.

In this embodiment, the upper surface 20*a* extends toward the toe-side of the club head, forming plural steps. However, the upper surface 20*a* is not limited to such configuration. The upper surface 20*a* may be inclined in a linear fashion or arc-like fashion while extending toward the toe-side of the club head, so that the height Ha is increased toward the toe-side of the club head.

As shown in FIG. 3, in the bottom view of the club head, the width Wa of the lower surface 20*b* of the first part 20 measured in the front-back direction of the club head is preferably increased toward the toe-side of the club head. Thereby, the above-explained function can be effectively derived.

In this embodiment, the lower surface 20*b* includes a heel-side part 22*a* whose width Wa is smoothly gradually increased toward the toe-side of the club head, and a toe-side part 22*b* whose width Wa is substantially constant and which is merged with the heel-side part 22*a*.

It is preferable that the toe-side end of the heel-side part 22*a* is positioned on the toe-side of the sweet spot SS.

The shape of the lower surface 20*b* of the first part 20 is not limited to the above example. For example, the width Wa of the lower surface 20*b* may be continuously increased up to the toe-side end 20*t* of the first part 20.

As shown in FIG. 5 and FIG. 6, the second part 21 as the hosel 3 includes an outer surface 21*a* forming a part of the outer surface of the club head 1, and a contact surface 21*b* extending in the up-and-down direction.

The second part 21 is configured such that, by inserting the first part 20 into the groove 19, the contact surface 21*b* of the second part 21 contacts with the heel-side end surface 14 of the head main body 10.

Accordingly, by inserting the first part 20 into the groove 19, the motion of the weight member 11 in this embodiment is inhibited, and the weight member 11 is uniquely positioned with respect to the front-back direction and toe-heel direction of the club head.

In the club head 1 in this embodiment, therefore, an accurate assembling of the head main body 10 and the weight member 11 can be made readily, and a high production efficiency can be obtained.

As shown in FIG. 6, in the front view under the standard state, when the weight member 11 is divided into a heel-side region Hr, a toe-side region Tr and a middle region Cr by equally dividing a horizontal length AW of the weight member 11 into three parts, the mass of the heel-side region Hr and the mass of the toe-side region Tr are more than the mass of the middle region Cr. Thereby, a large right-and-left moment of inertia can be obtained certainly.

Based on the structure shown in FIGS. 1 to 6, a club head having specifications shown in Table 1 was experimentally manufactured, and measured for the height of the center of gravity of the head, the height of the sweet spot and the right-and-left moment of inertia.

Figure 7:
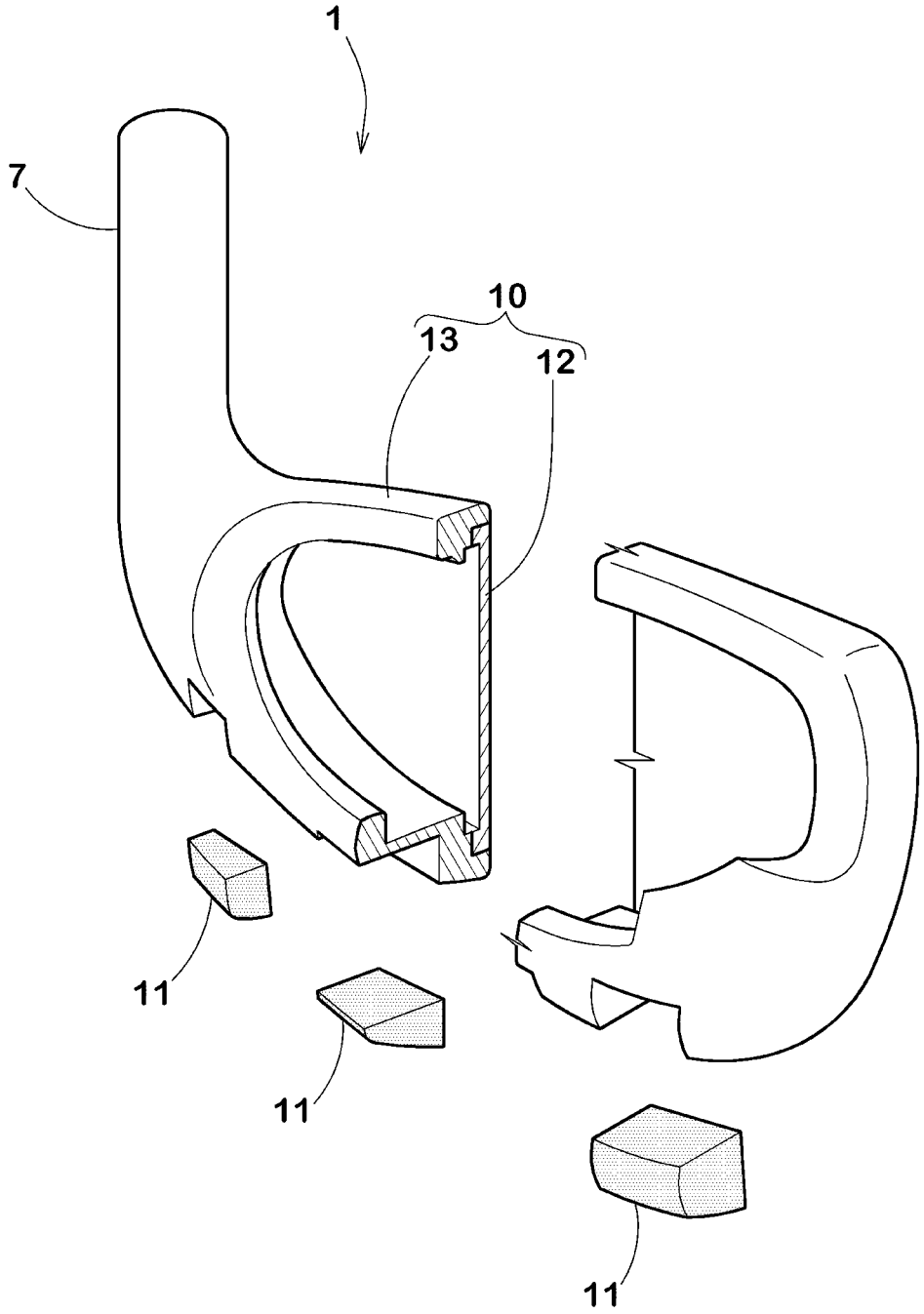
FIG. 7 is an exploded perspective view of an iron-type golf club head used as a comparative example.

Further, a club head provided with three weight members 11 as shown in FIG. 7 was prepared and measured similarly. Specifications common to all the club heads are as follows.

Club head: #6 iron

Lie angle alpha: 61.5 degrees

Loft angle beta: 27 degrees

Weight member's material: tungsten alloy (specific gravity: 9.5)

Face member's material: titanium alloy (specific gravity: 4.38)

Face-receiving part's material: SUS630 (specific gravity: 7.78)

Specific gravity of head main body: 5.71

<Height of Center of Gravity>

In the standard state of the club head, a vertical height from the horizontal plane HP to the center G of gravity was measured as the height of the center of gravity of the head. The results are shown in Table 1, wherein the smaller value is better.

<Height of Sweet Spot>

In the standard state of the club head, a vertical height from the horizontal plane HP to the sweet spot SS was measured as the height of the sweet spot. The results are shown in Table 1.

<Moment of Inertia>

In the standard state of the club head, the right-and-left moment of inertia and an up-and-down moment of inertia which is a moment of inertia of the club head around a horizontal axis passing through the center of gravity of the head in parallel with the toe-heel direction are measured by the use of a moment of inertia measuring instrument, Model No. 005-002, manufactured by Inertia Dynamics Inc. The results are shown in Table 1.

TABLE 1

| Head | Comparative example | Embodiment |
|---|---|---|
| Sweet spot height (mm) | 20.3 | 19.8 |
| Center of gravity height (mm) | 38.9 | 39.0 |
| Right-and-left moment of inertia (g sq. cm) | 2933 | 2973 |
| Up-and-down moment of inertia (g sq. cm) | 682 | 707 |

From the measured results, it was confirmed that the club head according to the present invention can be significantly improved in the height of the center of gravity, and the height of the sweet spot and the moment of inertia.

While description has been made of preferable embodiments of the present invention, the illustrated embodiments should not be construed as to limit the scope of the present invention; various modifications are possible without departing from the scope of the present invention.

The invention claimed is:

1. An iron-type golf club head having a face for hitting a ball, a sole extending backward from the lower edge of the face and extending in the toe-heel direction of the head so as to define the bottom surface of the club head, and a hosel extending upward in a heel-side of the face and provided with a shaft inserting hole, comprising:

a head main body including the face and the sole, and a weight member having a specific gravity larger than that of the head main body and fixed to the head main body, wherein the weight member integrally includes a first part extending in the toe-heel direction in the sole, and a second part constituting at least substantial portion of the hosel, the sole is provided with a groove extending in the toe-heel direction, and the first part of the weight member is inserted into the groove.

2. The golf club head according to claim 1, wherein a toe-side end of the first part is positioned on the toe-side of a sweet spot of the face.

3. The golf club head according to claim 2, wherein in a standard state of the club head set on a horizontal plane at its specified lie angle and loft angle, the first part has an upper surface whose height from the horizontal plane is increased toward the toe-side of the club head.

4. The golf club head according to claim 2, wherein in the bottom view of the club head in a standard state of the club head set on a horizontal plane at its specified lie angle and loft angle, the width of the first part measured in the front-back direction of the club head is increased toward the toe-side of the club head.

5. The golf club head according to claim 1, wherein a toe-side end of the first part is positioned at a distance not more than 20 mm from a toe-side end of the face.

6. The golf club head according to claim 5, wherein in a standard state of the club head set on a horizontal plane at its specified lie angle and loft angle, the first part has an upper surface whose height from the horizontal plane is increased toward the toe-side of the club head.

7. The golf club head according to claim 5, wherein in the bottom view of the club head in a standard state of the club head set on a horizontal plane at its specified lie angle and loft angle, the width of the first part measured in the front-back direction of the club head is increased toward the toe-side of the club head.

8. The golf club head according to claim 1, wherein in a standard state of the club head set on a horizontal plane at its specified lie angle and loft angle, the first part has an upper surface whose height from the horizontal plane is increased toward the toe-side of the club head.

9. The golf club head according to claim 8, wherein in the bottom view of the club head in a standard state of the club head set on a horizontal plane at its specified lie angle and loft angle, the width of the first part measured in the front-back direction of the club head is increased toward the toe-side of the club head.

10. The golf club head according to claim 1, wherein in the bottom view of the club head in a standard state of the club head set on a horizontal plane at its specified lie angle and loft angle, the width of the first part measured in the front-back direction of the club head is increased toward the toe-side of the club head.

11. The golf club head according to claim 1, wherein the head main body has a heel-side end surface extending in the up-and-down direction, the second part has a contact surface extending in the up-and-down direction, and the contact surface is confronted with the heel-side end surface by the insertion of the first part of the weight member into the groove.

12. The golf club head according to claim 1, wherein the head main body is a composite body of a stainless steel and a titanium alloy, and the weight member is made of a tungsten alloy.

* * * * *